United States Patent [19]

Sakai et al.

[11] Patent Number: 4,838,720

[45] Date of Patent: Jun. 13, 1989

[54] PAPER GUIDE OF PRINTER FOR WORD-PROCESSOR

[75] Inventors: Masaaki Sakai, Toyokawa; Sadao Ishihara, Toyohashi; Touma Shimoyama, Toyokawa, all of Japan

[73] Assignee: Minolta Camera Kabushiki Kaisha, Osaka, Japan

[21] Appl. No.: 135,541

[22] Filed: Dec. 18, 1987

Related U.S. Application Data

[63] Continuation of Ser. No. 32,959, Mar. 31, 1987, abandoned, which is a continuation of Ser. No. 746,341, Jun. 19, 1985, abandoned.

[30] Foreign Application Priority Data

Jun. 25, 1984 [JP] Japan ..... 59-95854[U]

[51] Int. Cl.[4] ..... B41J 13/10; B41J 29/16

[52] U.S. Cl. ..... 400/642; 400/718

[58] Field of Search ..... 400/357, 600, 600.2, 400/600.3, 603, 603.1, 630, 631, 642, 646, 647, 647.1, 694, 698, 717, 718, 718.1, 718.2, 604, 629; 312/208; 248/1 A, 1 B, 1 C, 1 E, 1 F, 1 H, 1 I, 1 J, 442.2

[56] References Cited

U.S. PATENT DOCUMENTS

| | | | |
|---|---|---|---|
| D. 280,100 | 8/1985 | Ungar | D14/103 |
| 847,428 | 3/1907 | McCormack | 400/631 |
| 953,559 | 3/1910 | Spiro | 400/357 |
| 1,488,782 | 4/1924 | Felbel | 400/647 |
| 2,971,628 | 2/1961 | Griffith | 400/718 X |
| 3,049,211 | 8/1962 | Demmel et al. | 400/647 X |
| 4,449,762 | 5/1984 | Turner | 312/208 X |
| 4,493,573 | 1/1985 | Hashimoto et al. | 400/647.1 |

*Primary Examiner*—Charles Pearson

*Attorney, Agent, or Firm*—Watson, Cole, Grindle & Watson

[57] ABSTRACT

In a word processor which includes a display unit, a keyboard unit and a printer, the display unit and the printer being viewable by an operator of the keyboard unit, a paper guide device which is detachably mountable on the printer to feed paper to be printed on into the paper inlet slot of the printer has a flat guide surface against which the paper to be printed on can be positioned and a draft holding member which is movable between a first position which allows paper which is placed against the flat guide surface to be supplied into the paper inlet slot and a second position wherein draft paper placed against the flat guide surface will be supported thereon for viewing by an operator of the keyboard unit.

7 Claims, 4 Drawing Sheets

PAPER GUIDE OF PRINTER FOR WORD-PROCESSOR

CROSS REFERENCE TO RELATED APPLICATIONS

The present application is a continuation of application Ser. No. 032,959, filed Mar. 31, 1987, now abandoned which in turn was a continuation of application Ser. No. 746,341, filed June 19, 1985, now abandoned.

BACKGROUND OF THE INVENTION

1. Field of the Invention

This invention relates to a word-processor and, more particularly to a paper guide device adapted to be placed on a printing paper inlet slot of a printer of a word-processor.

2. Description of the Related Art

When using a word-processor to type in text from a draft using a keyboard, an operator generally has to look back and forth from the draft to the display screen in order to input the necessary information, to make additions, to make deletions, etc.

Since the operator has to look repeatedly at both the draft and the display screen during the keyboard operation, it is advantageous that the draft be positioned as near as possible to the display screen. It is also preferable to locate both the display screen and the draft at the same eye level to reduce operator fatigue.

Most conventional word-processors do not have appropriate places to set the draft. Therefore, an operator generally has to conduct the keyboard operation with the draft placed on the desk on which the word processor is positioned. Although this situation can be corrected to a certain degree by providing a special stand, such a stand requires its own space and costs extra.

SUMMARY OF THE INVENTION

Accordingly, an object of the present invention is to provide a paper guide device for the printer of a word-processor which can be also used as a draft stand in order to overcome the problems mentioned above.

According to the present invention, there is provided a word-processor which includes at least a keyboard unit, a display unit, and a printer the printer including a paper inlet slot and a paper guide device, the display unit and the paper guide device being arranged to be visible to an operator handling the keyboard unit. The paper guide device, which is arranged on the printer and has a flat paper guide surface which defines a paper passage along which paper is fed into the paper inlet slot, includes a draft holding member arranged at a lower position thereof. The holding member is movable between a first position away from the guide face to allow the paper to pass through the passage into the inlet slot and a second position in which at least a part of the holding member interrupts the passage to enable holding of a draft in cooperation with the guide surface.

When operating the keyboard unit, the operator sets the draft holding member in its second position and puts a draft on the holding member, thus the paper guide device serves as a draft holder. When printing, the operator moves the holding member to the first position. The paper guide device then serves to guide paper into the printer inlet slot.

DESCRIPTION OF THE PREFERRED EMBODIMENTS

Figure 1:
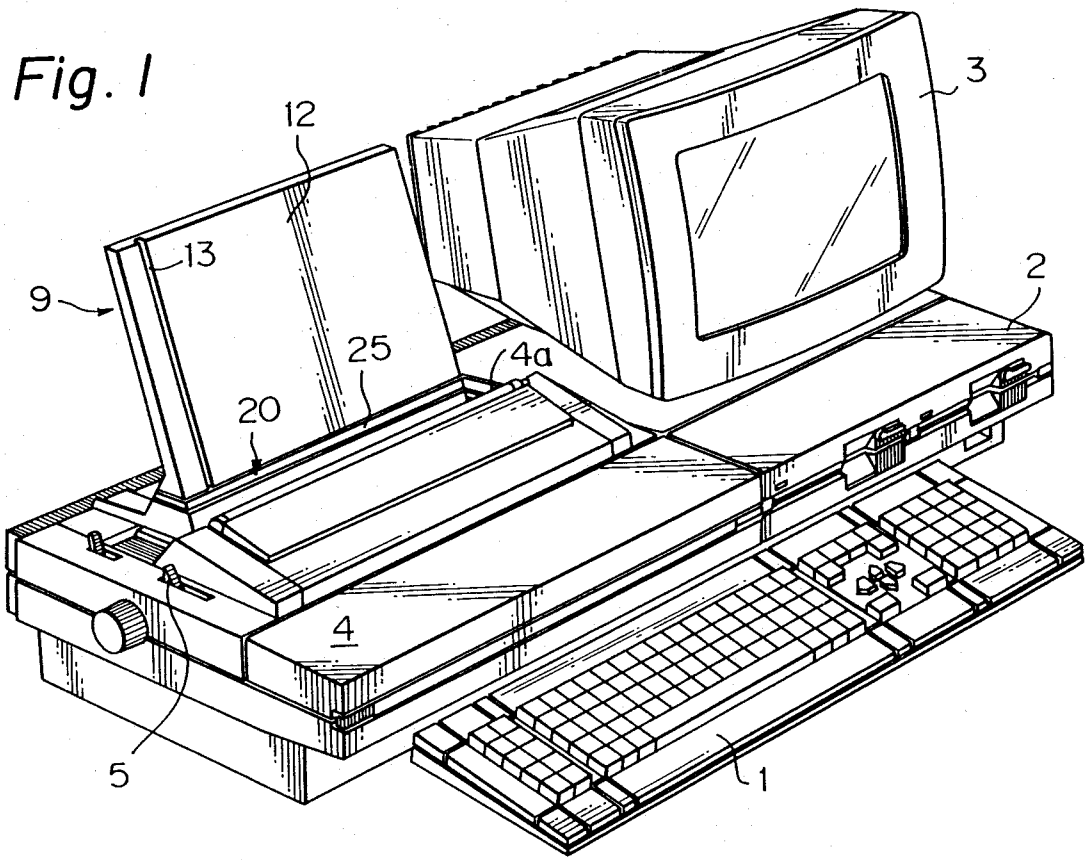
FIG. 1 is a perspective view of a word-processor according to the present invention.

Referring now to the drawings, FIG. 1 illustrates a word-processor provided with a paper guide device according to the present invention. An input keyboard unit, generally designated by reference numeral 1, is shown in front of an operator (not shown). A recording floppy disk (FD) unit 2 and a cathode-ray tube (CRT) 3 for displaying the input information are shown at the right and a printer 4 for printing out the text drafted on the CRT is shown at the left.

The printer 4 has an upper surface containing a paper or sheet inlet slot **4*a* and on which is located with a paper guide device generally designated by reference numeral 9, which serves not only as a guide means for inserting paper into the sheet inlet slot 4*a*, but also as a draft setting or holding stand. When printing, paper (not shown) is placed on the paper guide device 9 for successive insertion into the paper inlet slot 4*a*. A paper set lever 5** is pulled forward, so that the printing paper is held by feed rollers (not illustrated).

Figure 2:
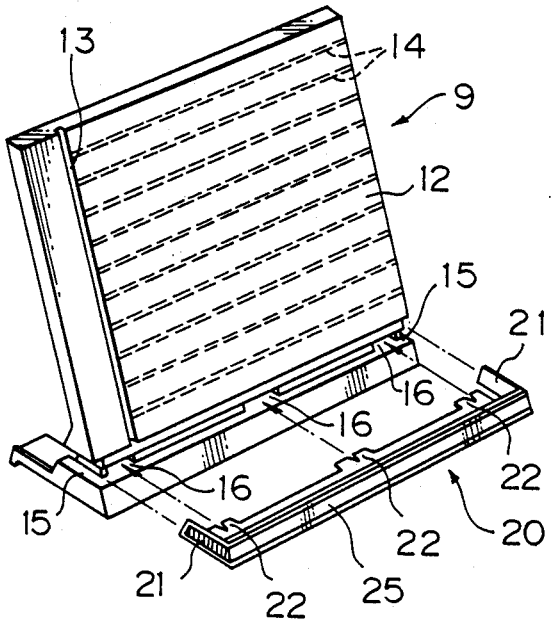
FIG. 2 is an exploded perspective view of a paper guide device according to one embodiment of the present invention.
Figure 3:
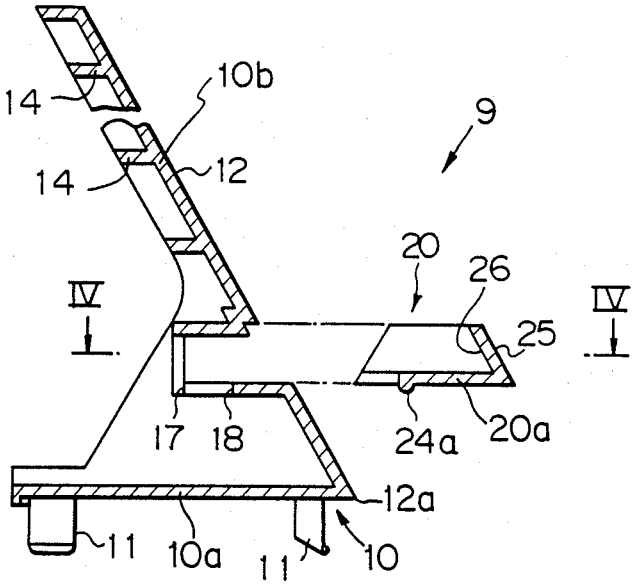
FIG. 3 is a vertical cross-sectional view of the paper guide device shown in FIG. 2.
Figure 4:
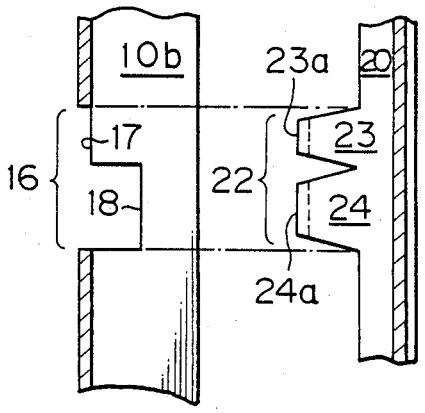
FIG. 4 is a horizontal cross-sectional view taken along a line IV—IV in FIG. 3.

The paper guide device 9 will now be described in detail with reference to FIGS. 2 through 4, FIG. 2 shows a perspective view of the paper guide, FIG. 3 shows a vertical cross-sectional view thereof, and FIG. 4 shows a horizontal cross-sectional view of a main portion thereof.

The paper guide device 9 includes a base element 10 and a holding device 20. The base element 10 is made of a transparent material, such as plastic and it includes a bottom member **10*a* and a face member 10*b*. The base element 10 is detachably mounted on the printer above the paper inlet slot 4*a* by means of hooks 11 that project downwardly from the face member 10*b*. The face member 10*b* has an inclined front guide surface 12 for supporting paper to be printed on or for supporting a draft, this inclined front guide surface being planar and defining a straight lower edge 12*a*. The face member 10*b* is also a vertical groove 13 for determining the proper positioning of the paper, and it has a back surface provided with transverse, equidistantly spaced ribs 14. These ribs 14 can be seen from the front surface 12 of the face member 10*b* on which the paper or draft is placed so as to measure (check) the size of the paper placed on the front guide surface 10*b*** or for setting line-to-line distances.

The holding device 20 which is made of a flexible or resilient material such as plastic, is mounted on the base element 10 near the lower end of the face member **10*b* and is about the same length as the width of the face member 10*b*. The holding device 20 which is in the form of a tray and includes a floor 20***a* and a front wall 25, is movable between a retracted position where its front wall 25 is flush with the front guide surface 12 and a drawn-out position where its recessed portion 26 protrudes to receive one end of a draft placed on the guide surface 12. The holding device 20 has at the ends thereof a pair of jaws 21 which can be inserted into and horizontally and slidingly guided along a pair of parallel guide grooves 15 provided at the lateral sides of the base element 10. The holding device 20 also has three engaging portions 22 which engage with corresponding slots 16 of the base element 10 to limit the movement of the holding device 20 between its retracted and drawn-out positions.

As seen from FIG. 4, each of the engaging portions 22 includes two engaging pieces 23 and 24 which have at the ends thereof lower projections 23*a* and 24*a*, respectively. On the other hand, the base element 10 is provided at the bottom wall of each of its slots 16 with stepped depressions including a first shallow depression 17 engagable with the projection 23*a* and a second deep depression 18 engagable with the projection 24*a*.

Figure 5:
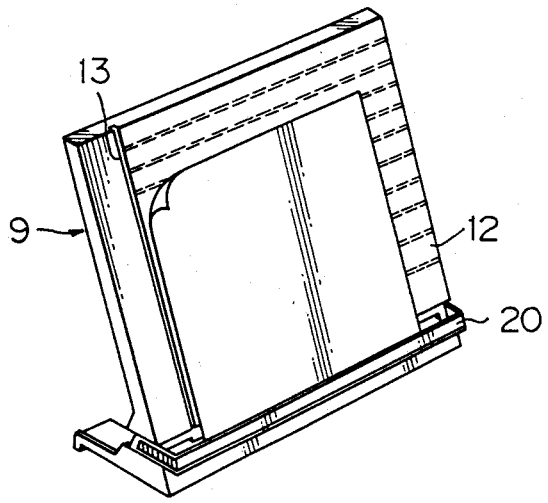
FIG. 5 is a perspective view of the same paper guide device with a draft supported thereon.

With the paper guide device 9 as mentioned above, when the operator sets a draft, he draws the holding device 20 forward so that the projection 23*a* comes out of the first depression 17 and slides along the bottom wall of the slot 16. The other projection 24*a* comes into contact with the second depression 18 to stop the holding member 20 at this drawn-out position. In this position, as illustrated in FIG. 5, the holding device 20 protrudes from front guide surface 12 to receive the draft in its recess portion 26 (see FIG. 3).

When the operator intends to feed paper for printout, he pushes the holding device 20 back in until the projection 23*a* engages with the first depression 17. The holding device 20 is thus positioned with front wall 25 flush with the front guide surface 12. In this position, the front wall 25 defines a part of the front guide surface 12 and the paper can be smoothly fed into the paper inlet slot 4*a* without hindrance by the holding device 20.

Figure 6:
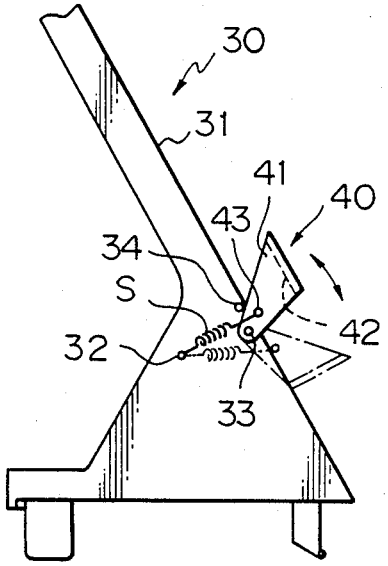
FIG. 6 is a side elevational view of a paper guide device according to a second embodiment of the present invention.

An alternative embodiment of the holding device will now be described with reference to FIG. 6.

In this embodiment, a paper guide device 30 is provided at the lower portion thereof with a holding device (or swing member) 40 of about the same length as the width of a flat guide surface 31 of the base element 30. The holding device 40 has ends (arms) 41 bent perpendicularly with respect to the main (horizontal) part of the holding device which is provided with a draft supporting face 42. The holding device 40 is rotatably secured by the bent ends 41 thereof to the side faces of the base element 30 by means of pins 33. Each of the ends 41 of the holding device 40 is provided with another pin 43 to which a tension coil spring S is connected, the spring S being connected at its other end to a pin 32 on the side face of the base element 30. This pin 32 is arranged such that the axial line of the spring S moves over the pin 33 which defines the rotation center point of the holding device 40 when the holding device 40 is rotated in the direction as shown by the arrow. Therefore, the spring S acts to urge and retain the holding device 40 either at the position in which the draft supporting face 42 is in contact with the front guide surface 31 or at the position in which the ends 41 of the holding device 40 are in contact with the pins 34 on the side faces of the base element 30. As understood from the above, the former position is used for setting the draft and the latter for setting paper for printout.

As will be clearly understood from the above description, according to the present invention, the paper guide device can be used not only as a guide means for feeding paper into the printer, but also as a draft stand, thus eliminating the need for a separate, expensive draft-holding stand.

What is claimed is:

1. In a word-processor which includes a display unit, a keyboard unit and a printer, said printer having an upper surface containing a paper inlet slot, and a paper guide means located on the upper surface of said printer for guiding paper positioned thereagainst downwardly into said paper inlet slot, and said display unit and said paper guide means being positioned to be simultaneously viewable by an operator typing on said keyboard unit, the improvement wherein said paper guide means comprises a base element which provides a flat guide surface against which paper can be positioned, said flat guide surface being substantially planar throughout the entire extent thereof and having a straight lower edge and a horizontal opening in said flat guide surface, and a tray element including a floor and a front wall which is connected to said floor, said tray element being movably mounted on said base element between a first position and a second position relative to said flat guide surface, and wherein when said tray element is in said first position, said floor is located within said horizontal opening and said front wall is flush with said flat guide surface on to allow paper to be printed on to pass downwardly relative to said flat guide surface and into said paper inlet, and when said tray element is in said second position, said floor extends away from said flat guide surface together with said front wall so as to be capable of retaining draft paper placed thereon, said tray element being located entirely ahead, in the direction of paper flow, of said paper inlet slot.

2. A word-processor as claimed in claim 1, wherein said base element is detachably mounted on said upper surface of said printer and wherein said face member extends upwardly with respect the upper surface of said printer and is inclined away from the operator of said keyboard unit when said bottom member is mounted on said printer.

3. A word-processor as defined in claim 1, wherein said tray element includes jaws at its opposite ends, and wherein said base element includes grooves in which said jaws are slidingly positioned.

4. A word-processor as defined in claim 3, wherein said tray element includes engaging members having stop projections which limit the movement of said tray element in and out of said horizontal opening.

5. In a word-processor which includes a display unit, a keyboard unit and a printer, said printer having an upper surface containing a paper inlet slot, and a paper guide means located on the upper surface of said printer for guiding paper positioned thereagainst downwardly into said paper inlet slot, and said display unit and said paper guide means being positioned to be simultaneously viewable by an operator typing on said keyboard unit, the improvement wherein said paper guide means comprises a base element which provides a flat guide surface against which paper can be positioned, said flat guide surface being substantially planar throughout the entire extent thereof and having a straight lower edge, and a swing member including a horizontal portion which defines a flat paper-supporting surface and arm portions at respective opposite ends of said horizontal portion which are pivotally connected to said base element so as to move said swing member between first and second positions relative to said flat guide surface, and wherein when said swing member is in said first position, said horizontal portion is spaced away from said flat guide surface to allow paper to be printed on to pass downwardly between said flat guide surface and said horizontal portion into said paper inlet slot, and when said swing member is in said second position, said horizontal portion is in abutting contact with said flat guide surface such that the flat paper-supporting surface thereof is capable of supporting draft paper placed thereon, said swing member being located entirely ahead in the direction of paper flow, of said paper inlet slot.

6. A word-processor as defined in claim 5, wherein said base element includes stop pins for stopping the pivotal movement of said swing member at its first position.

7. A word-processor as defined in claim 6, including spring means connected between said swing member and said base element to resiliently retain said swing member in said first position once manually positioned in said first position or resiliently retain said swing member in said second position once manually positioned in said second position.

* * * * *